US006840809B2

(12) United States Patent
Wu

(10) Patent No.: US 6,840,809 B2
(45) Date of Patent: Jan. 11, 2005

(54) ELECTRICAL CONNECTOR HAVING IMPROVED CONTACTS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/418,700

(22) Filed: Apr. 18, 2003

(65) Prior Publication Data

US 2004/0009707 A1 Jan. 15, 2004

Related U.S. Application Data

(63) Continuation-in-part of application No. 10/194,121, filed on Jul. 11, 2002, now Pat. No. 6,716,068.

(51) Int. Cl.[7] ..... H01R 23/70
(52) U.S. Cl. ..... 439/636; 439/637
(58) Field of Search ..... 439/636, 637, 439/60, 737.1, 630, 633, 634

(56) References Cited

U.S. PATENT DOCUMENTS 4,286,837 A * 9/1981 Yasutake et al. ..... 439/637
5,702,257 A * 12/1997 Millhimes ..... 439/79
5,800,203 A * 9/1998 Pratt et al. ..... 439/637
6,312,296 B1 11/2001 Jones

* cited by examiner

*Primary Examiner*—Alex Gilman
(74) *Attorney, Agent, or Firm*—Wei Te Chung

(57) ABSTRACT

An electrical connector (1) includes a dielectric housing (2) and a number of first and second contacts (3, 4) received in the housing. Each first contact includes an intermediate portion (30), an engaging portion (32) extending upwardly from a top end of the intermediate portion and a compliant portion (34) extending downwardly from a bottom end of the intermediate portion for connecting to a printed circuit board. The intermediate portion is coplanar with the compliant portion and is formed with a tab (300) substantially perpendicular to the compliant portion. The tab abuts against the housing for resisting an upward force exerted on the first contact.

17 Claims, 9 Drawing Sheets

ELECTRICAL CONNECTOR HAVING IMPROVED CONTACTS

CROSS-REFERENCE TO RELATED APPLICATIONS

This patent application is a continuation-in-part (CIP) of U.S. patent application Ser. No. 10/194,121 filed on Jul. 11, 2002 now U.S. Pat. No. 6,716,068 and entitled "LOW PROFILE ELECTRICAL CONNECTOR HAVING IMPROVED CONTACTS".

Relevant subject matter is also disclosed in a co-pending U.S. Patent Application with an Ser. No. 10/405,784, filed on Apr. 1, 2003 and entitled "LOW PROFILE ELECTRICAL CONNECTOR HAVING IMPROVED TERMINALS", which is invented by the same inventor as this patent application and assigned to the same assignee with this application.

BACKGROUND OF THE INVENTION

1. Field of the Invention

The present invention relates to an electrical connector, and particularly to an electrical connector having contacts reliably retained in an insulating housing thereof.

2. Description of Related Art

Serial Advanced Technology Attachment (Serial ATA) connectors are generally used for connecting storage peripheral devices such as hard disk drives with a printed circuit board of a computer so as to achieve signal or power transmission therebetween.

Some Serial ATA connectors are provided with press-fit contacts for facilitating mounting the connectors on a printed circuit board. When using the press-fit contacts that engage inner surfaces of corresponding plated through holes of the printed circuit board, it is desirable to have a high enough retention force to ensure a reliable electrical connection between the connector and the printed circuit board. The press-fit contact with a high retention force typically requires a high insertion force, which results in an upward movement of the contact relative to the housing during the downward insertion of the contact into the plated through hole of the printed circuit board. Even worse, the contact may be pushed out from the housing. As a result, the connector is unreliably mounted on the printed circuit board and an electrical connection therebetween is adversely affected.

On the other hand, the press-fit contacts of the Serial ATA connector generally have mating portions arranged in a common row for engaging with a complementary connector and compliant portions arranged in two rows in a staggered manner for connecting to a printed circuit board. In order to conform to new footprints of the printed circuit board on which the Serial ATA connector is mounted, it is necessary to design new press-fit contacts having compliant portions respectively located in a center portion along which a longitudinal axis of the connector extends and a side portion offset from the center portion.

U.S. Pat. No. 6,312,296 (the '296 patent), assigned to the same assignee with this patent application, discloses an electrical connector comprising an insulating housing and a plurality of first-type press-fit contacts received in the housing. The housing is formed with a ledge at a bottom thereof with pockets defined therein. Each first-type contact includes a supporting shoulder and a transverse portion respectively abutting against opposite sides and a base of a corresponding pocket, whereby the first-type contacts have enhanced retention force in the housing during the insertion of the contacts into corresponding plated through holes of a printed circuit board. Although the first-type contacts of the '296 patent are reliably retained in the housing, they cannot be used in the Serial ATA connector since they do not conform to the new footprints of the printed circuit board.

Hence, a Serial ATA connector having new press-fit contacts is required.

SUMMARY OF THE INVENTION

Accordingly, an object of the present invention is to provide an electrical connector having improved press-fit contacts which can be reliably retained in an insulating housing thereof.

In order to achieve the object set forth, an electrical connector in accordance with the present invention comprises a dielectric housing and a plurality of first and second contacts received in the housing. Each first contact includes an intermediate portion, an engaging portion extending upwardly from a top end of the intermediate portion and a compliant portion extending downwardly from a bottom end of the intermediate portion for connecting to a printed circuit board. The intermediate portion is coplanar with the compliant portion and is formed with a tab substantially perpendicular to the compliant portion to abut against the housing for resisting an upward force exerted on the first contact.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
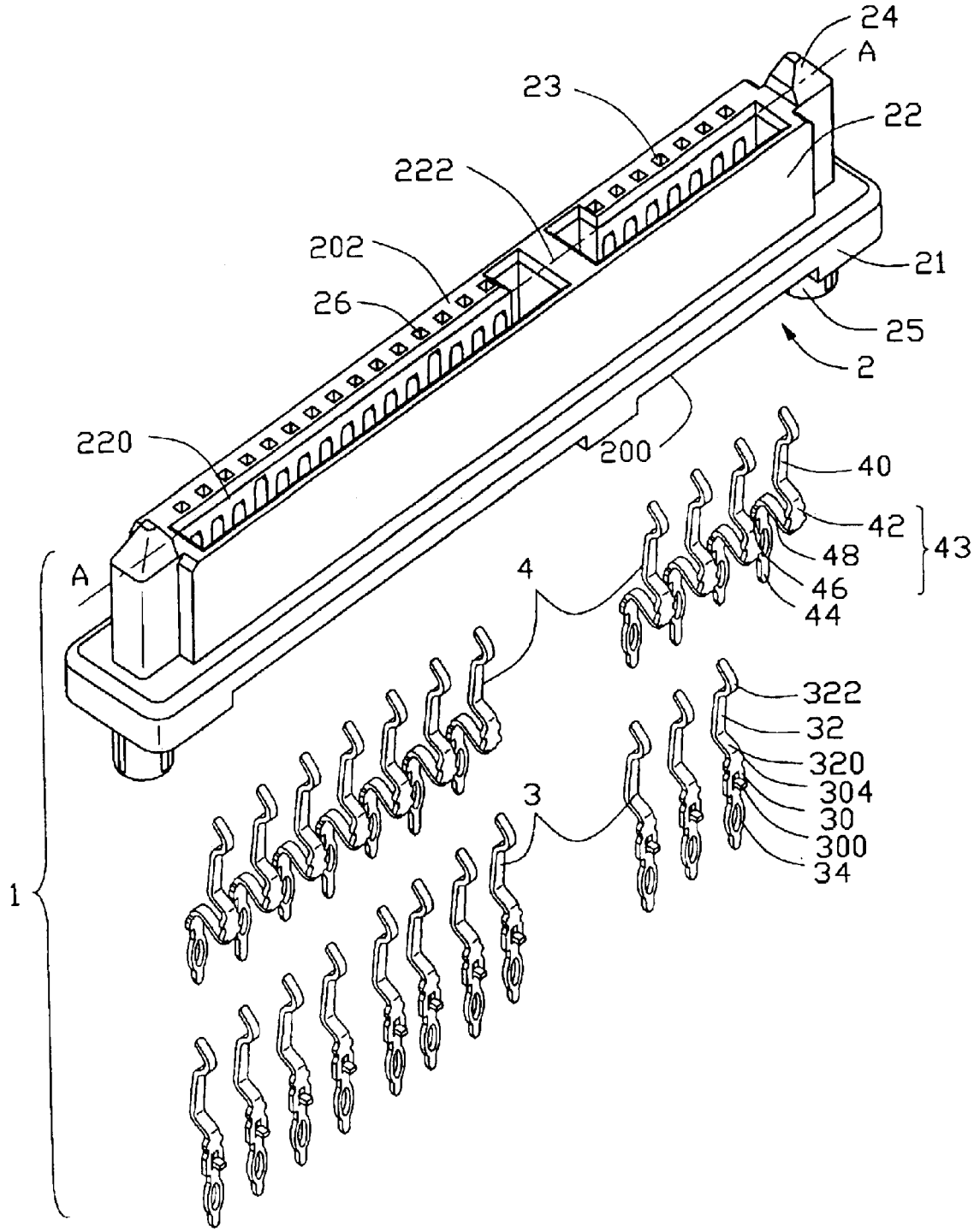
FIG. 1 is an exploded, perspective view of an electrical connector in accordance with the present invention.
Figure 2:
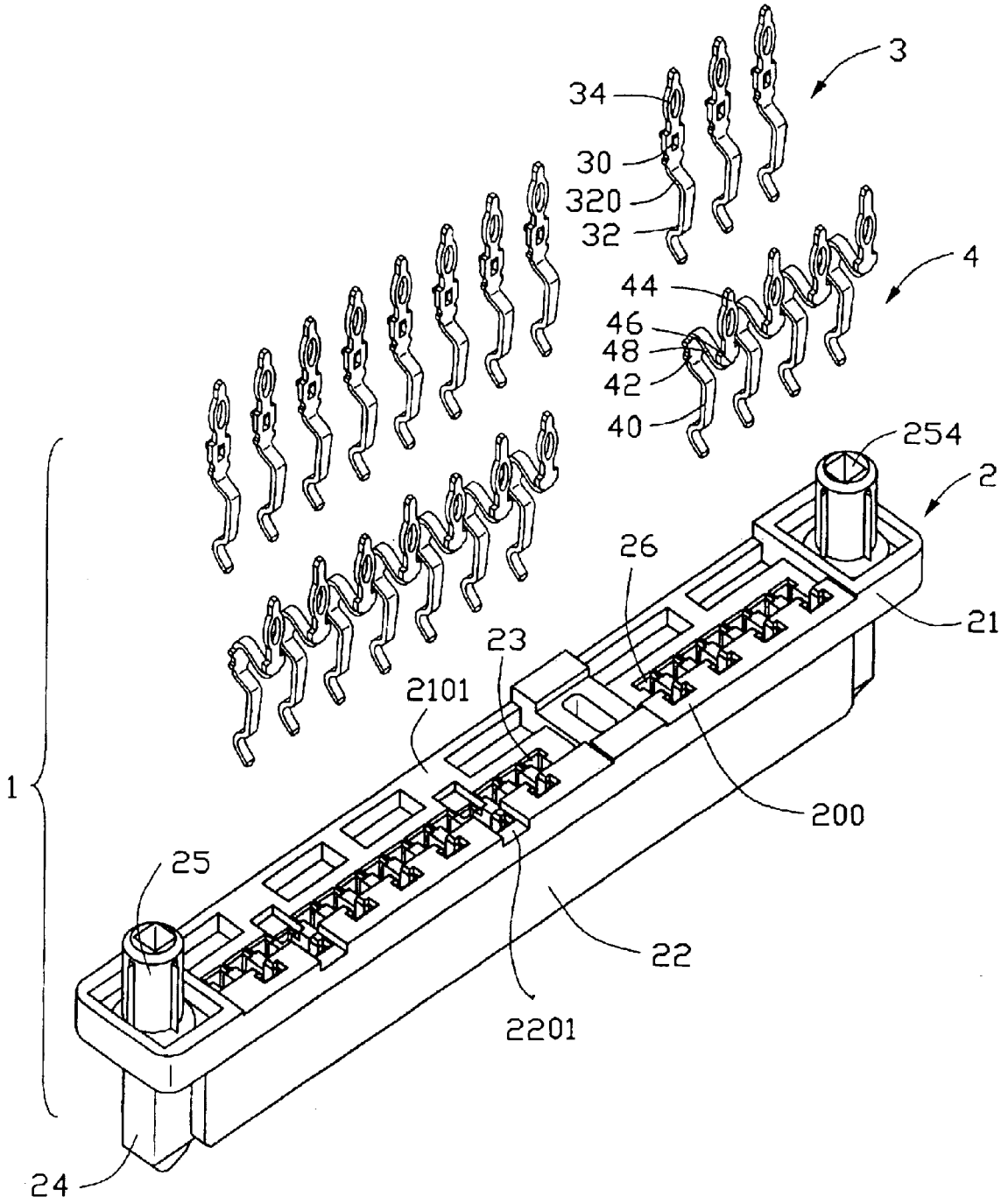
FIG. 2 is a view similar to FIG. 1 but taken from a different perspective.

Referring to FIGS. 1 and 2, an electrical connector 1 in accordance with the present invention comprises an elongate insulating housing 2 and a plurality of first and second contacts 3, 4 retained in the housing 2.

The housing 2 includes a base portion 21 and a mating portion 22 extending upwardly from the base portion 21. The mating portion 22 defines a receiving slot 220 along a lengthwise direction thereof. The receiving slot 220 is separated into first and second parts by a partition 222. The base portion 21 defines a recess 210 (FIG. 6) in a mounting surface 200 of the housing 2. The housing 2 defines a plurality of first passageways 23 extending from a mating face 202 through a bottom face 2101 of the recess 210, and a plurality of second passageways 26 extending from the mating face 202 through the bottom face 2101 of the recess 210 and the mounting face 200 of the housing 2. The first and second passageways 23, 26 are alternatively arranged in a common row along the lengthwise direction of the housing 2 and each communicate with the receiving slot 220.

The housing 2 is formed with a pair of guiding posts 24 on opposite longitudinal ends of the mating portion 22 for guiding the insertion of a complementary connector (not shown) and a pair of positioning posts 25 downwardly extending beyond the mounting face 200 and vertically aligned with the corresponding guiding posts 24 for positioning the connector 1 on a printed circuit board (not shown). Each positioning post 25 defines a hole 254 extending from a free end thereof into the corresponding guiding post 24 to prevent the housing 2 from warping during the molding process. The mounting face 200 further defines cutoffs 2201 for compliance with some contacts having different dimensions/configurations from the rest.

Each first contact 3 includes an intermediate portion 30, an engaging portion 32 extending upwardly from a top end of the intermediate portion 30 and a compliant portion 34 extending downwardly from a bottom end of the intermediate portion 30. The compliant portion 34 and the intermediate portion 30 are coplanar with each other. The engaging portion 32 has a bent portion 320 connecting with the top end of the intermediate portion 30 to allow the engaging portion 32 and the compliant portion 34 offsetting from each other in a horizontal direction. The engaging portion 32 has a curved contact section 322 substantially aligned with the compliant portion 34 along a lengthwise direction of the first contact 3. The intermediate portion 30 has a retaining portion 301 defining a plurality of barbs 304 at opposite sides thereof and a tab 300 substantially perpendicular to the retaining portion 301 and the compliant portion 34. The tab 300 has a free end 302 (FIG. 6) extending beyond the contact section 322 along the horizontal direction.

Each second contact 4 includes a resilient contact portion 40, a tail portion 44 and a medial portion 43 connected between the resilient contact portion 40 and the tail portion 44. The medial portion 43 has a first securing portion 42 at a top portion thereof, a second securing portion 46 at a bottom portion thereof and a bending portion 48 connected between a bottom of the first securing portion 42 and a top of the second securing portion 46. The first securing portion 42 and the second securing portion 46 are offset from each other in the horizontal direction. The top of the second securing portion 46 is higher than the bottom of the first securing portion 42 along a lengthwise direction of the second contact 4. Since the second contacts 4 as well as the relationship between the second contacts 4 and the housing 2 are disclosed in the parent application, the detailed description thereof is omitted here.

Figure 3:
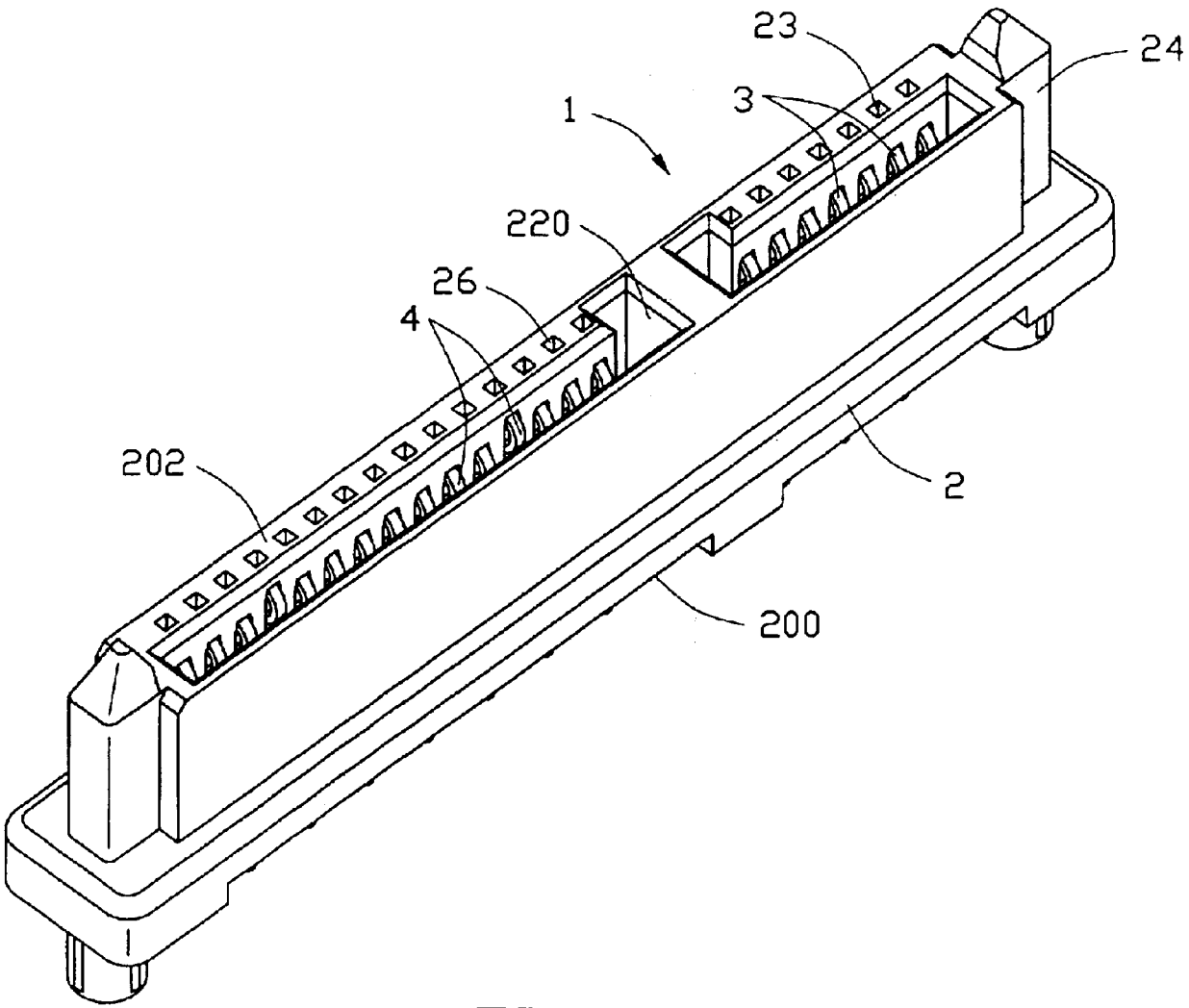
FIG. 3 is an assembled, perspective view of the electrical connector shown in FIG. 1.
Figure 4:
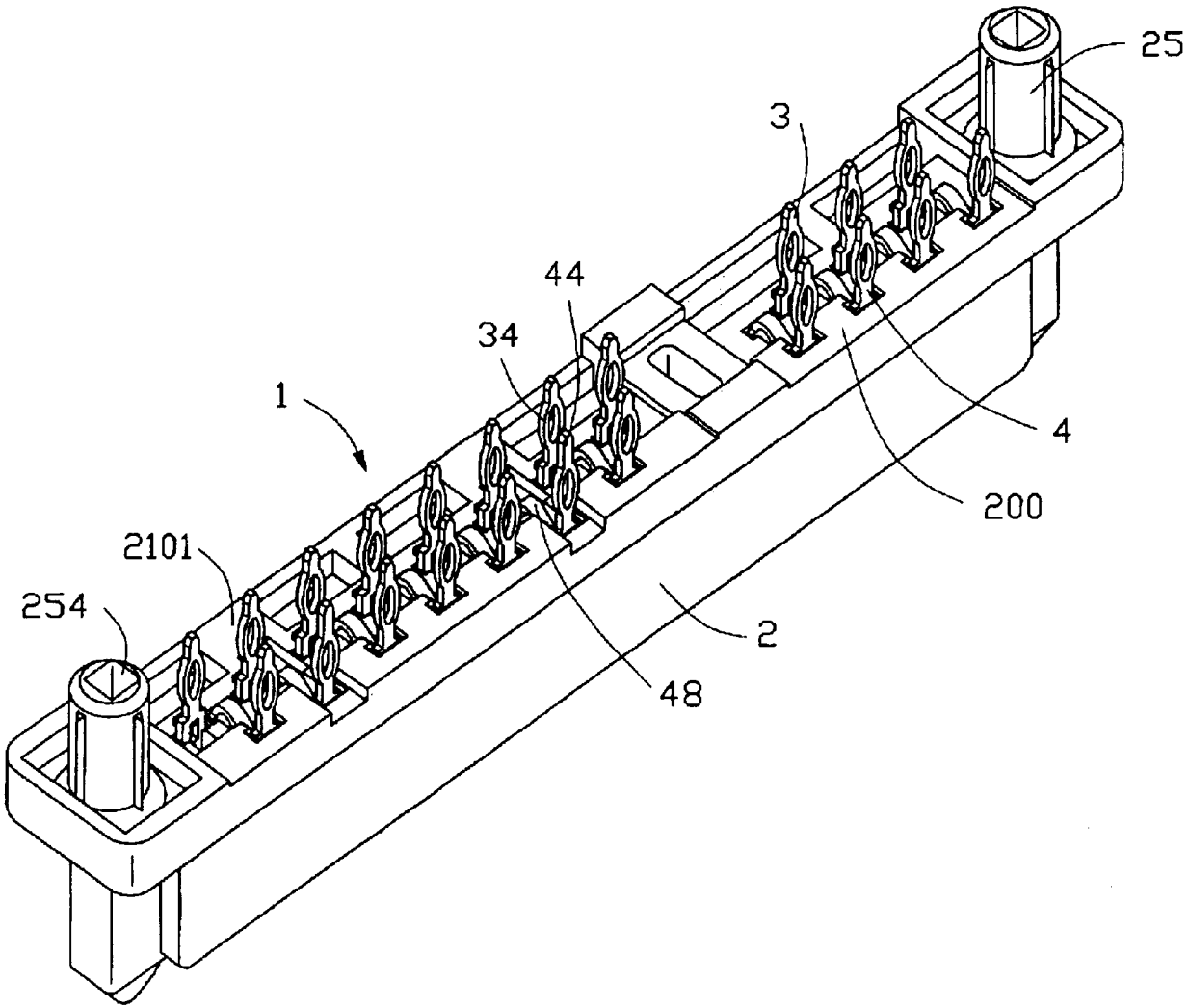
FIG. 4 is an assembled, perspective view of the electrical connector shown in FIG. 2.
Figure 5:
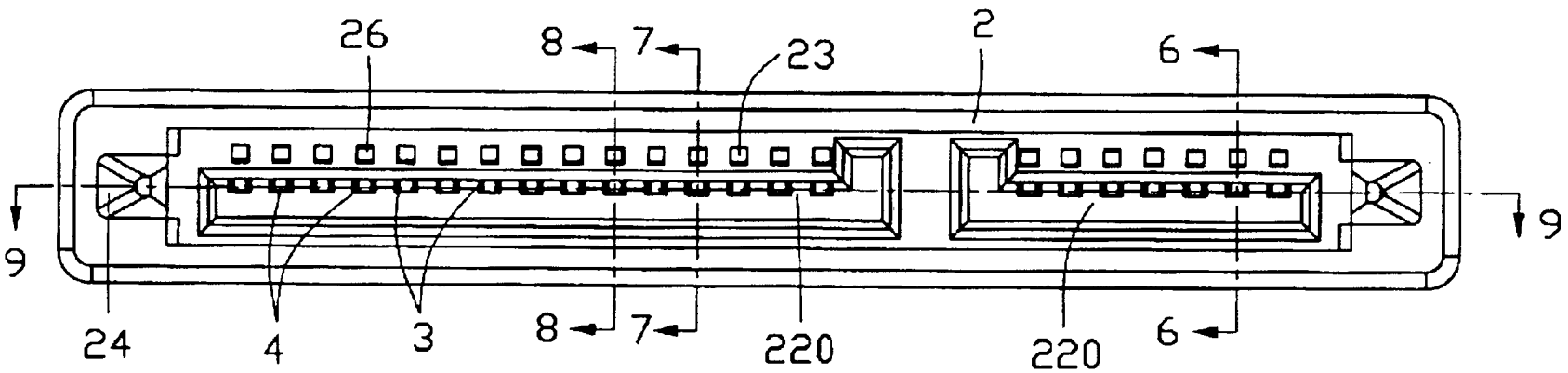
FIG. 5 is a top planar view of the electrical connector of FIG. 1.
Figure 7:
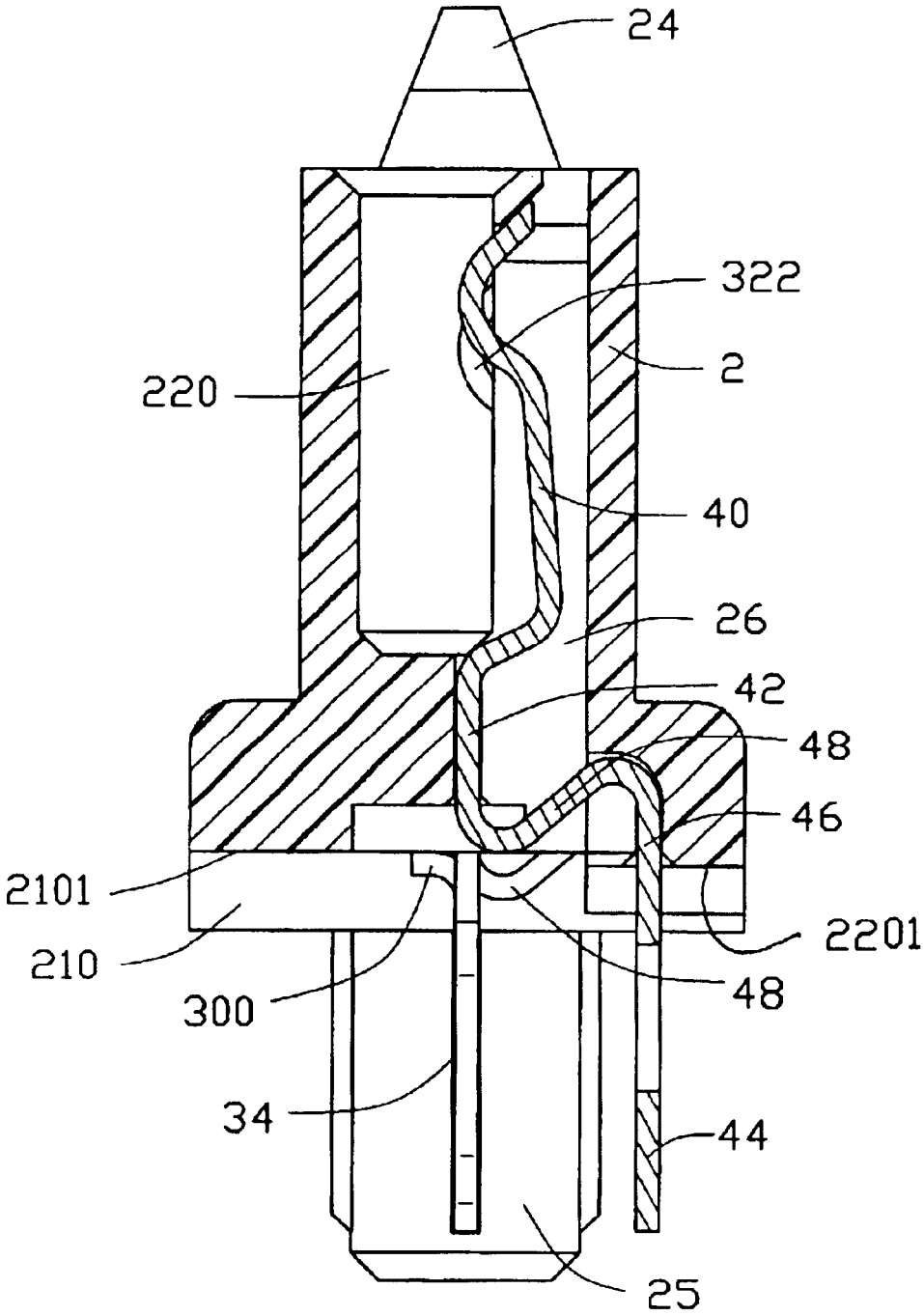
FIG. 7 is a cross-sectional view of the connector taken along line 7—7 of FIG. 5.
Figure 8:
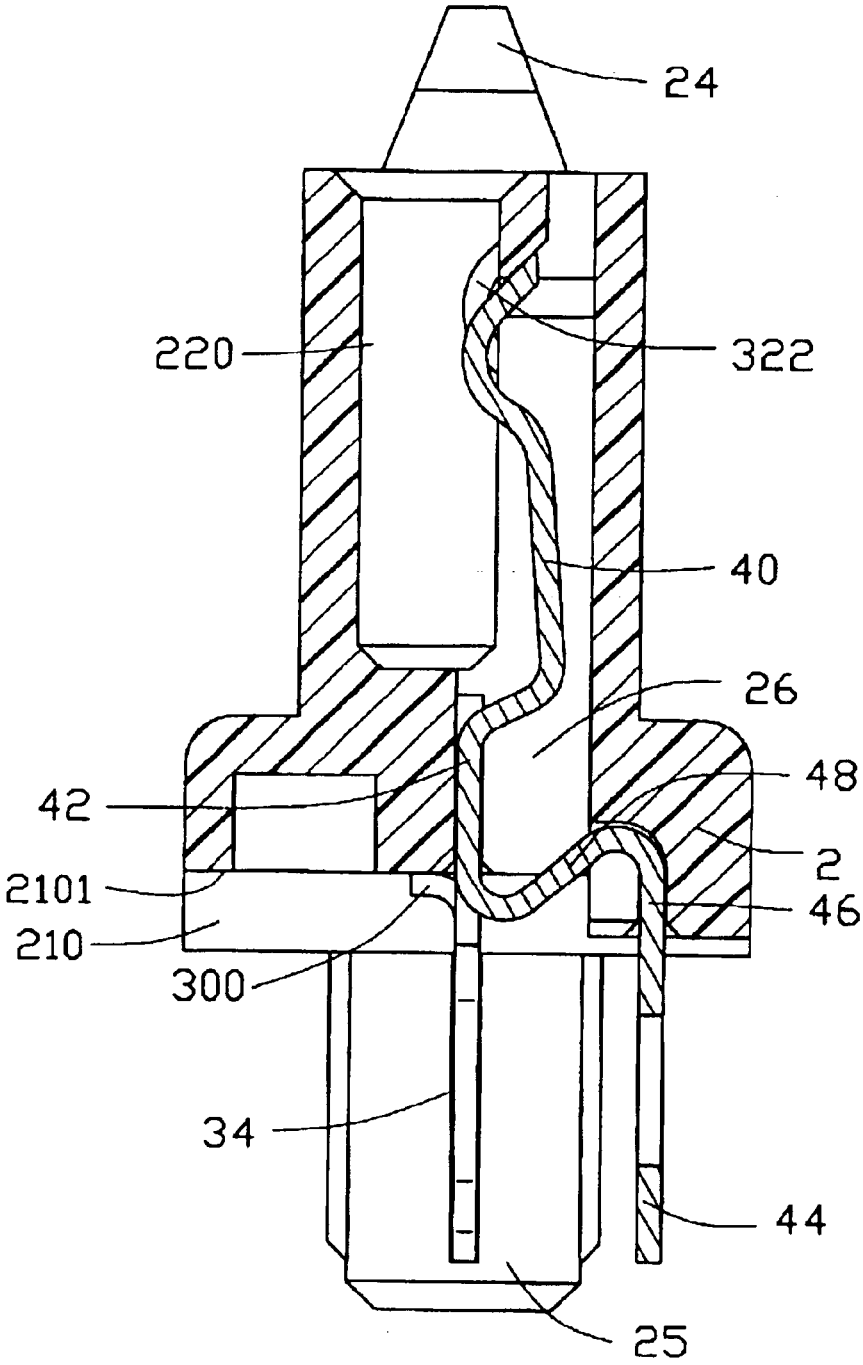
FIG. 8 is a cross-sectional view of the connector taken along line 8—8 of FIG. 5.

Referring to FIGS. 3–5, the first and the second contacts 3, 4 are respectively inserted into the first and second passageways 23, 26 of the housing 2 from the mounting face 200. FIGS. 7 and 8 clearly show the second contacts 4 retained in the housing 2.

Figure 6:
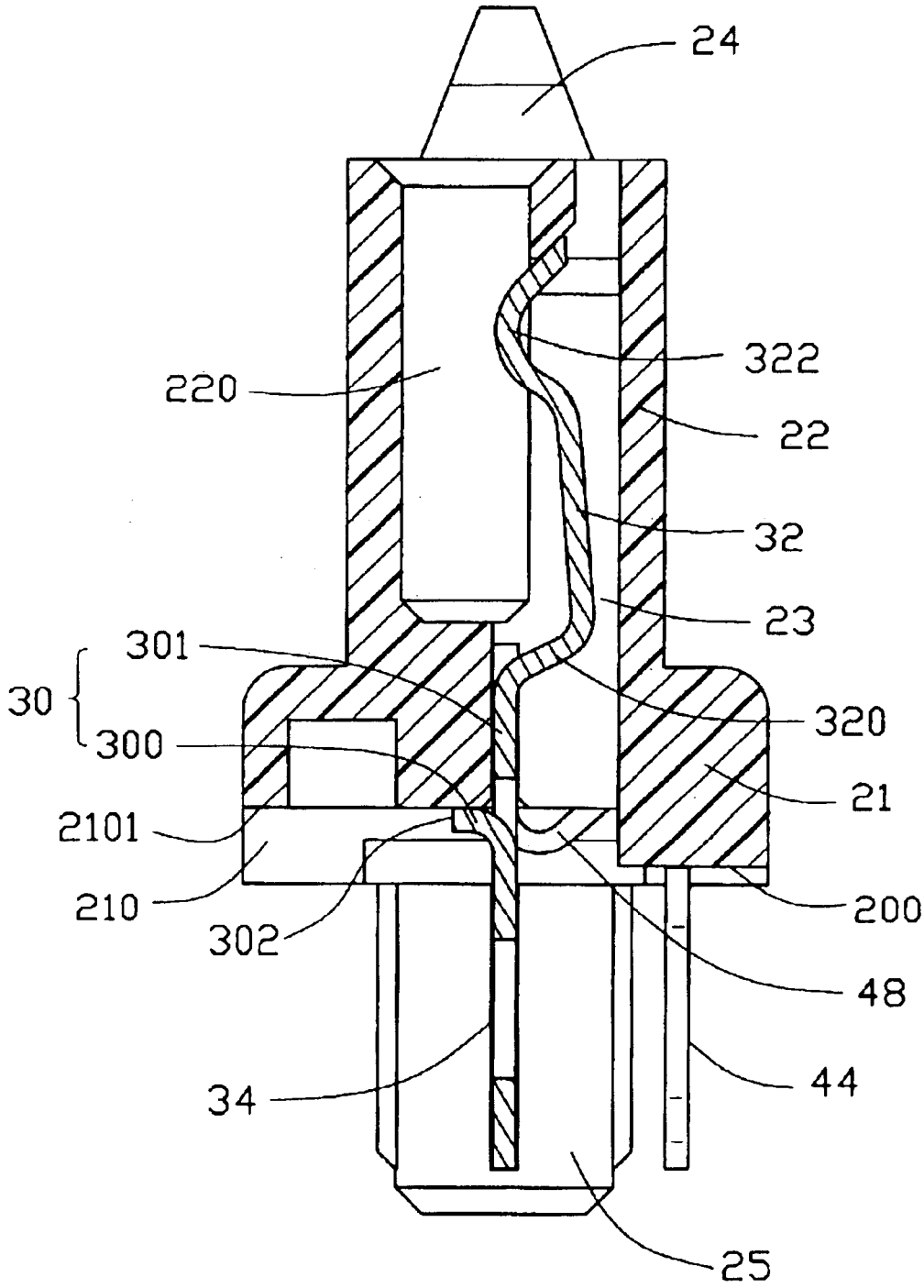
FIG. 6 is a cross-sectional view of the connector taken along line 6—6 of FIG. 5.
Figure 9:
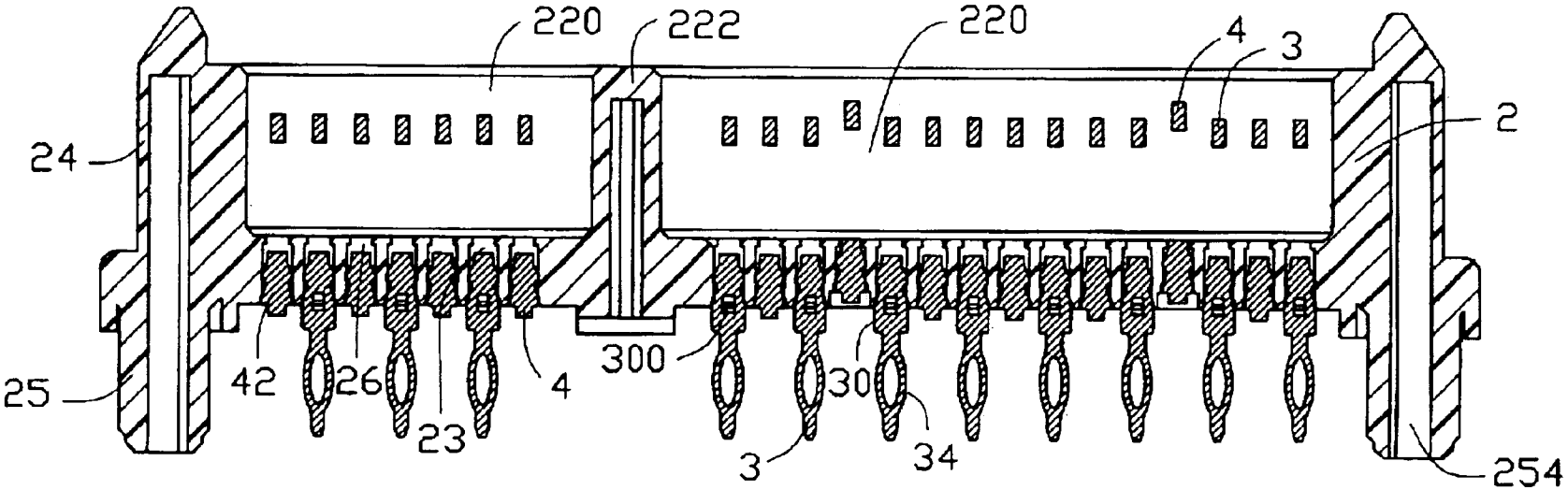
FIG. 9 is a cross-sectional view of the connector taken along line 9—9 of FIG. 5.

Further referring to FIGS. 6 and 9, the first contacts 3 are retained in the housing 2 via an interferential engagement between the barbs 304 of the retaining portions 301 and inner faces of the passageways 23. The curved contact sections 322 of the first contacts 3 project into the receiving slot 220 for engaging with the complementary connector. The compliant portions 34 extend beyond the mounting surface 200 of the housing 2 and are located in a center portion of the housing 2 along which a longitudinal axis A (shown in FIG. 1) of the housing 2 extends. The tabs 300 of the first contacts 3 abut against the bottom face 2101 of the recess 210 of the housing 2.

When the compliant portions 34 of the first contacts 3 are press-fitted into corresponding plated through holes of the printed circuit board, the tab 300 of the first contact 3 snugly abut against the bottom face 2101 of the housing 2 to resist an upward force exerted on the first contact 3, thereby ensuring a reliable retention of the first contacts 3 in the housing 2. Thus, the connector 1 is reliably mounted on the printed circuit board and a reliable electrical connection therebetween is ensured.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a dielectric housing defining a plurality of first and second passageways therein; and a plurality of first and second contacts respectively received in the first and second passageways of the housing, each of the first and second contacts comprising an engaging portion, a tail portion for connecting to a printed circuit board, and an intermediate portion connecting the engaging portion with the tail portion, the intermediate portion of the first contact comprising one securing portion of a first type and one securing portion of a second type to retain the first contact in the housing, the intermediate portion of the second contact comprising two securing portions of the first type to retain the second contact in the housing, the two securing portions of the first contact being substantially perpendicular to each other wherein the first type securing portions of the first and the second contacts are parallel to the portions of the first and the second contacts.

2. The electrical connector as claimed in claim 1, wherein the two securing portions of the second contacts are substantially parallel to the securing portion of the first type of the first contact.

3. The electrical connector as claimed in claim 1, wherein the intermediate portion of the second contact comprises an oblique bending portion connected between the two securing portions of the second contact.

4. The electrical connector as claimed in claim 1, wherein the tail portions of the first contacts are located in a center portion of the housing along which a longitudinal axis of the housing extends.

5. The electrical connector as claimed in claim 1, wherein the intermediate portion and the tail portion of the first contact are coplanar with each other.

6. The electrical connector as claimed in claim 1, wherein the engaging portion of the first contact has a contact section substantially aligned with the tail portion along a lengthwise direction of the first contact.

7. The electrical connector as claimed in claim 1, wherein the securing portion of the first type of the first contact interferentially fits in a corresponding first passageway, and the securing portion of the second type of the first contact abuts against a bottom of the housing.

8. The electrical connector as claimed in claim 7, wherein the two securing portions of the second contact offset from each other along a horizontal direction.

9. The electrical connector as claimed in claim 8, wherein the two securing portions of the second contact interferentially fit in a corresponding second passageway.

10. An electrical connector for being mounted on a printed circuit board, comprising:

a dielectric housing; and a plurality of contacts received in the housing, each contact comprising an engaging portion, a tail portion for connecting to the printed circuit board, and an intermediate portion connecting the engaging portion with the tail portion to retain the contact in the housing, the intermediate portion comprising a tab substantially perpendicular to the tail portion and abutting against a bottom surface of the housing around a center longitudinal line of the housing wherein the tail portion of the contacts are located in the center line of the housing for resisting an upward force exerted on the contact, the tab having a free end extending beyond the tail portion along a lateral direction of the housing.

11. The electrical connector as claimed in claim 10, wherein the intermediate portion and the tail portion of the contact are coplanar with each other.

12. The electrical connector as claimed in claim 10, wherein the engaging portion of the contact has a contact section substantially aligned with the tail portion along a lengthwise direction of the contact.

13. An electrical contact for being used in an electrical connector which is mounted on a printed circuit board, comprising:

an upward engaging portion adapted for engaging with a complementary connector;

a downward compliant portion adapted for connecting to the printed circuit board; and an intermediate portion connected between the engaging portion and the compliant portion, the intermediate portion being coplanar with the compliant portion and comprising a tab substantially perpendicular to the compliant portion adapted for abutting against an insulating housing of the connector to resist an upward force exerted on the contact, the engaging portion having a contact section extending in a lateral direction of the contact, the tab extending in a same direction with the contact section and having a free end extending beyond the contact section in the lateral direction.

14. The electrical contact as claimed in claim 13, wherein the engaging portion has a contact section substantially aligned with the compliant portion along a lengthwise direction of the contact.

15. An electrical connector comprising:

a dielectric housing defining a row of passageways;

a plurality of first type contacts and a plurality of second type contacts alternately disposed in the passageways, respectively;

the first type contact defining an extended first lengthwise dimension from top to bottom, the second type contact defining an extended second lengthwise dimension from top to bottom, said first dimension being shorter than said second dimension, the first type contact defining a first tail provided with a first stopper upwardly abutting against the housing around a center longitudinal line of said housing, the second type contact defining a second tail provided with a second stopper upwardly abutting against the housing laterally offset from said center line; wherein some of said second type contacts are upwardly offset arranged in the housing in comparison with others of said second type contacts, and the housing defines some cutoffs around the corresponding passageways, respectively, for compliance with said some of the second type contacts.

16. The connector as claimed in claim 15, wherein said some of the second type contacts are longer than said others of the second type contacts from top to bottom in an extended manner.

17. The connector as claimed in claim 15, wherein the first stopper is formed by splitting portions thereof along a configuration of said first type contact, while the second stopper is formed by portions along a configuration of said second type contact without splitting.

* * * * *